United States Patent [19]

Scoones

[11] Patent Number: 4,720,954

[45] Date of Patent: Jan. 26, 1988

[54] SCREEN CEILING ASSEMBLY

[75] Inventor: Albert E. Scoones, Brisbane, Australia

[73] Assignee: Hunter Douglas International, N.V., Curacao, Netherlands Antilles

[21] Appl. No.: 930,832

[22] Filed: Nov. 14, 1986

[30] Foreign Application Priority Data

Nov. 20, 1985 [AU] Australia ..... 50203/85

[51] Int. Cl.[4] ..... E04B 5/52; F21V 17/02; F21V 7/00

[52] U.S. Cl. ..... 52/489; 52/473; 52/484; 362/325; 362/342

[58] Field of Search ..... 52/489, 484, 473; 362/325, 323, 342

[56] References Cited

U.S. PATENT DOCUMENTS

| | | | |
|---|---|---|---|
| 2,437,825 | 3/1948 | Kohn | 362/325 X |
| 2,552,982 | 5/1951 | Lambert | 52/473 X |
| 2,585,089 | 5/1961 | Gilmore | 52/473 X |
| 3,774,024 | 11/1973 | Deaton | 52/484 X |
| 3,911,638 | 10/1975 | Englund | 52/489 |
| 3,981,116 | 9/1976 | Reed | 52/484 |
| 4,222,094 | 9/1980 | Wolar | 362/325 X |
| 4,448,005 | 5/1984 | Vochelli | 52/473 |

FOREIGN PATENT DOCUMENTS

| | | | |
|---|---|---|---|
| 89905 | 9/1983 | European Pat. Off. | 52/484 |

*Primary Examiner*—Alfred C. Perham
*Attorney, Agent, or Firm*—Pennie & Edmonds

[57] ABSTRACT

A screen ceiling assembly including a plurality of spaced carrier members which are connectable to a supporting structure such as a roof. There is also provided a multiplicity of ceiling panels which are each positioned at an angle to a common frame through a plurality of the carrier members. There is also provided clip means interconnecting a respective ceiling panel and carrier member. The invention is characterized in that each of the ceiling panels is pivotably connected with each of its carrier members about a longitudinal axis parallel to the panel length axis by way of a pivot construction comprising one of the clip means or part thereof. This allows each panel to adopt a desired angled position in respect of each of the carrier members. Preferably each panel is retained in the desired angled position by retaining means.

11 Claims, 17 Drawing Figures

Fig.1.
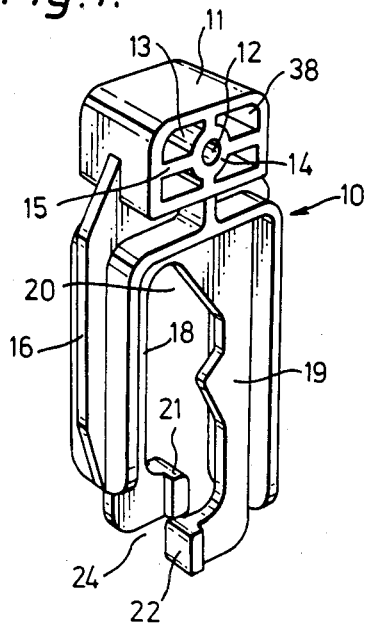
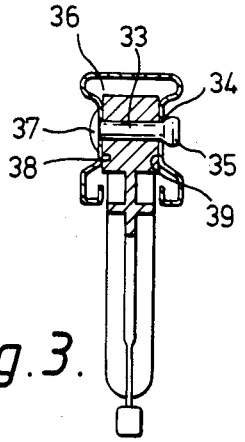
Fig.3.
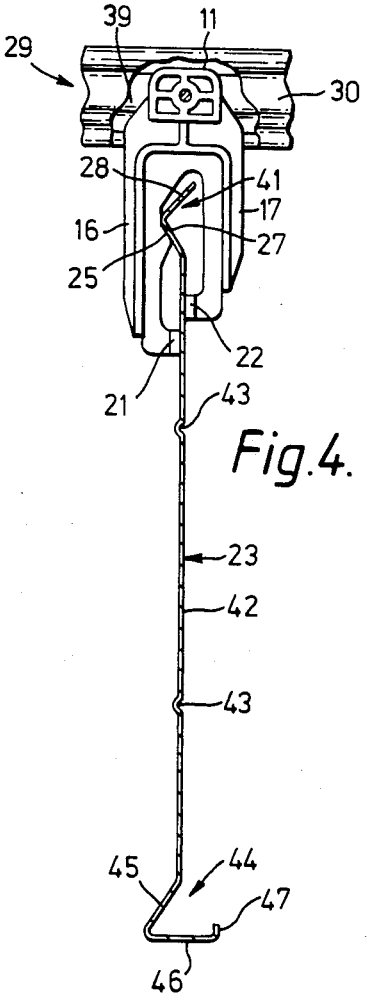
Fig.4.
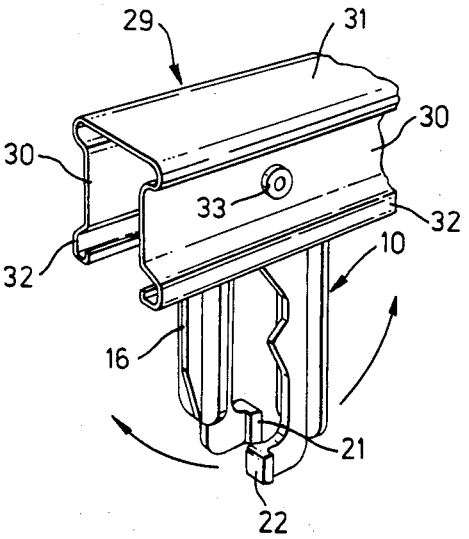
Fig.2.

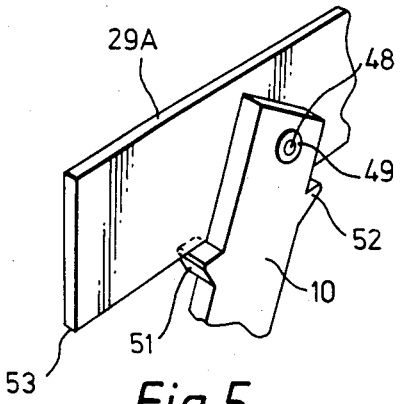
Fig.5.
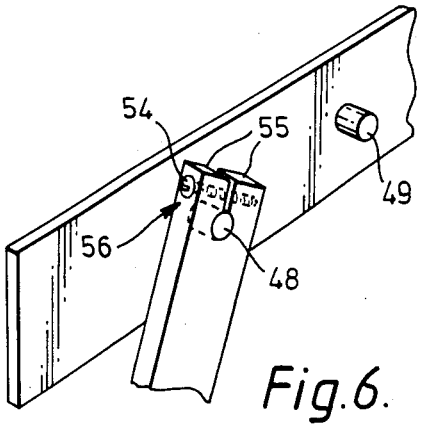
Fig.6.
Fig.7.
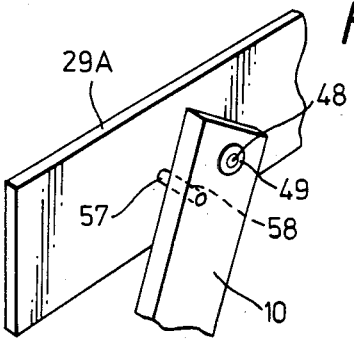
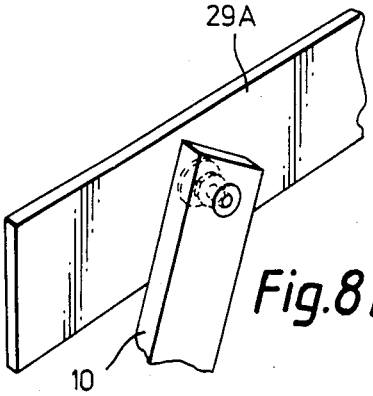
Fig.8A
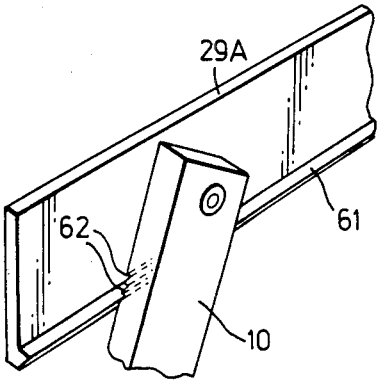
Fig.9.
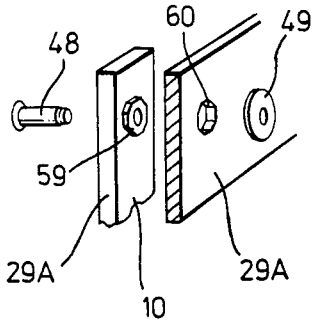
Fig.8B

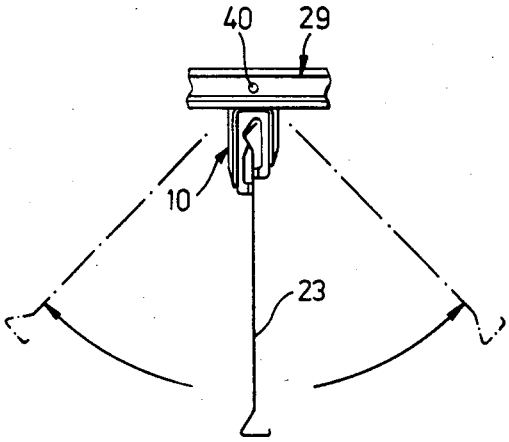
Fig. 13.
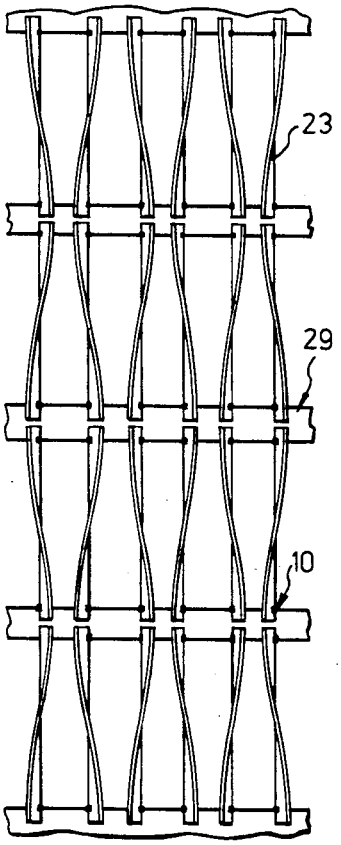
Fig.15.
Fig.16.
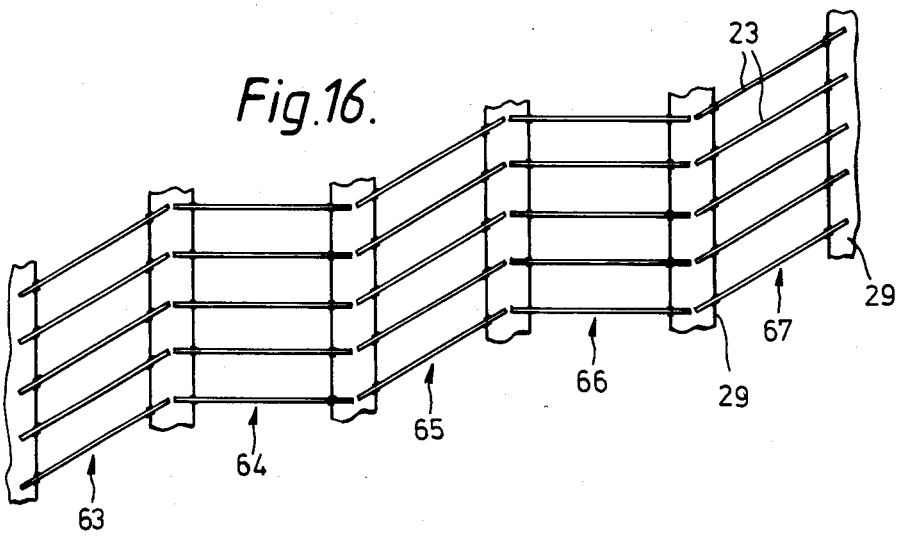

SCREEN CEILING ASSEMBLY

THIS INVENTION relates to a screen ceiling assembly and components for use therein and in particular clip elements which are used for interconnection of adjoining parts of the screen ceiling assembly.

Hitherto conventional screen ceiling assemblies have included a plurality of vertically oriented screens or panels attached in spaced relationship to a plurality of panel carrier rails or stringers. Usually the carrier rails were parallel to each other and arranged transversely to the plurality of panels. The carrier rails were usually suspended by cables or rods which were attached to a supporting roof structure.

In a first type of screen ceiling assembly the panels were engaged in snap fit or clipped relationship in mating sockets or notches in each carrier rail and during installation it was normally necessary for one installer to be stationed at each carrier rail so that an individual panel could be inserted uniformly into its respective mating notches.

In a second type of screen ceiling as described in U.S. Pat. No. 3,911,638 use was made of separate clips which interconnected the panels and the carrier rails. Each clip included an upper portion received in slots in a carrier rail and a lower spring clip portion gripping an upper marginal edge of a panel. Each carrier rail or stringer was a downwardly facing channel member having paired opposed slots formed therein. The upper portion of each clip included a pair of opposed tabs respectively received in an opposed pair of such slots and shaped so as to be readily insertable but to be effectively locked in position after insertion in the carrier rail slots. The clips could also be bent intermediate their upper and lower portions for orienting the major surface planes of the panels at a desired angle to the carrier rails so that the panel major surface planes are vertically oriented when the carrier rails are pitched at an angle to horizontal as over a stairway.

Each of the conventional screen ceiling assemblies were disadvantageous in that the panels were fixed in position relative to their associated carrier rails and thus although rotation or pivotal movement of each panel was possible about a transverse axis thereof (ie. normal to an associated carrier rail) at least insofar as the first type of assembly described above was concerned it was usually not possible to pivot the panel about a longitudinal axis thereof (ie. parallel to an associated carrier rail). This meant that conventional screen ceiling assemblies of the types described above were usually not versatile in operation or application because they were usually only able to be suspended from the carrier rails in a substantially vertical plane. It was also usually the case that the spacings between adjacent panels were substantially equal and unequal spacings were normally not envisaged.

According to the present invention there is provided a screen ceiling assembly comprising a plurality of spaced carrier members connectable to a support structure to form a common plane through said carrier members, a multiplicity of spaced elongate ceiling panels each having its own longitudinal axis, said panels being positioned at an angle to said common plane; clip means interconnecting each ceiling panel with at least one of said carrier members; and a pivotal connection associated with each clip means, effective to allow each ceiling panel to be pivoted about an axis parallel to its longitudinal axis, whereby each panel may be disposed at a desired angle or angles with respect to said common plane.

In such a construction it is readily possible to dispose each panel in the desired angled manner. It is possible, according to this construction, to have each panel angled bodily in the same plane, or to have different parts of the said panel disposed at different angles, thereby providing a twisted configuration to the panel.

The pivotal connection may be formed directly between the clip means and its associated carrier or, alternatively, each clip means may comprise a panel engagement portion and a separate head portion, the head portion being attached to the carrier member, the pivotal connection being provided between the panel engagement portion and the separate head portion. In the latter case, the separate head portion can be rigidly fixed to the carrier and the pivotal disposition of the panels can be effected by the pivotal connection within each clip means.

Advantageously retaining means are provided to retain each panel in the desired angled position and this may take many forms. For example they may comprise abutting elements on each clip means and its associated carrier, a detent element resiliently engagable in one or more recesses, an interengagable plug and socket arrangement or a retaining means which allows the pivoting at the pivotal connection to be effected incrementally, so that at least a part of each clip means may be retained in any one of number of different incremental angular positions relative to its associated carrier member.

The carriers may be of any suitable type and thus comprise a carrier rail suitably of channel cross section or a tubular rail or even a rod or elongate sheet member. However, a carrier rail of channel cross section is preferred.

The ceiling panels also may be of any suitable type and thus may comprise a plate-like member having a body portion optionally provided with one or more reinforcing ribs or grooves and one or more peripheral longitudinal flanges which may be hooked or oriented at right angles to the body portion. Preferably however the ceiling panel includes an upper flange of hooked or V or C shape and a lower flange of similar shape.

Preferably the clip means is unitary and thus comprise a clip element and include an upper part or head portion which is attached to the carrier by suitable attachment means and a lower part which may rigidly secure the ceiling panel but more preferably allows movement of the ceiling panel about a transverse axis. The attachment means may have associated therewith pivot means whereby the clip element and attached panel may be pivoted to the desired position. The attachment means may also have associated therewith retaining means to retain the clip element and attached panel in the desired position.

In a more preferred arrangement the clip element may include a head portion possessing a retaining aperture for an appropriate fastener and a pair of legs depending therefrom for grasping an associated panel. Suitably one leg is longer than the other so that the free ends of each leg may have vertically displaced or vertically spaced bearing locations upon mating engagement with the panel. This feature is advantageous in that it facilitates the abovementioned movement of the panel about a transverse axis.

There also may be provided a slot located between each leg which in a top portion thereof may be provided with one or more bearing parts which may mate with an associated flange or flanges of a V top flange of the ceiling panel.

The aforementioned pivot means and retaining means in one form may be common or integral and in one example of this arrangement there may be provided a rivet member which extends through the retaining aperture of the clip element and aligned opposed apertures located in each side flange of a channel shaped carrier rail so as to frictionally retain the head portion of the clip element in the channel shaped carrier rail whereby part of the head portion bears against an inner surface of an adjacent side flange of the carrier rail. In this arrangement the clip member may pivot about the rivet member and be retained in a vertical plane or in a plane offset to the vertical as may be required. In another example of a common pivot means there may be provided a self tapping screw insertable in the retaining aperture of the clip element and the aligned opposed apertures of the carrier rail or alternatively a nut and bolt may be utilized.

In another embodiment the pivot means and retaining means may be separate from each other and in this arrangement the clip may pivot about a pivot pin and be retained in a suitable position such as in a vertical plane or a plane offset to the vertical by retaining means such as a screw clamp extending through spaced portions of the clip element or by a plug-socket engagement between the clip and the carrier rail.

In a preferred example of the above embodiment the separate retaining means may be such as to enable the clip element to be pivoted through an angle offset to the vertical by increments such as by angular increments of 5 degrees. Various forms of this arrangement are illustrated in the drawings hereinafter.

Reference may now be made to a preferred embodiment of the present invention as illustrated in the accompanying drawings wherein:

FIG. 1 is a perspective view of a unitary clip for use in the screen ceiling assembly of the invention;

FIG. 2 is a perspective view of the clip of FIG. 1 attached to an associated carrier rail;

FIG. 3 is a sectional view through the assembly of FIG. 2;

FIG. 4 is a partly broken away screen ceiling assembly in accordance with the invention;

FIG. 5 is a schematic perspective view showing a first form of engagement between the clip of FIG. 1 and an associated carrier rail;

FIG. 6 is a view similar to FIG. 5 showing a second form of engagement;

FIG. 7 is a view similar to FIG. 5 showing a third form of engagement;

FIGS. 8A and 8B are views similar to FIG. 5 showing a fourth form of engagement;

FIG. 9 is a view similar to FIG. 5 showing a fifth form of engagement;

FIG. 13 is an end view of a screen ceiling constructed in accordance with the invention showing pivotal movement of the ceiling panel about a longitudinal axis;

FIG. 15 illustrates a particular arrangement based on the embodiment shown in FIG. 14; and FIG. 16 illustrates a further arrangement in addition to those shown in FIGS. 11 and 12.

Figure 10:
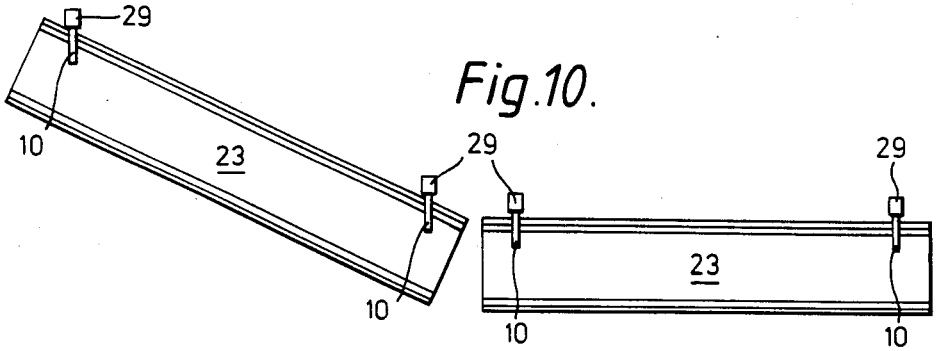
FIG. 10 is a side view showing a pair of panels hanging from associated carrier rails in a vertical plane, and showing a particular embodiment.

In the clip 10 shown in FIG. 1 there is illustrated head portion 11 with attachment or retaining aperture 12, hollow recesses 13 to reduce the weight of the clip and save on use of material, webs 14 and 15, external flanges 16 and 17, legs 18 and 19 and slot 20 located between legs 18–19. There is also shown bearing pads or feet 21 and 22 and it will be noted that foot 22 is longer than foot 21 as shown in FIG. 4 so as to bear against an associated panel 23 in spaced locations. This feature is useful in that it facilitates pivotal movement of panel 23 relative to clip 10 about a transverse axis and also allows easy insertion of panel 23 into slot 20 through entrance 24. Also shown is bearing face 25 of slot 20 which may bear against an adjacent face of flange 27 of panel 23 as shown in FIG. 4. The three point engagement between panel 23 and clip 10 shown in FIG. 4 enables the panel 23 to be securely retained in an associated clip 10. In FIG. 2 there is shown carrier rail 29 having opposed side flanges 30, web 31 and opposed bottom flanges 32. Also shown is rivet 33 extending through aligned apertures 34 in flanges 30. The rivet as shown in FIG. 3 has a deformed end portion 35 after insertion in apertures 34 so as to retain head portion 11 of clip 10 securely in channel 36 of carrier rail 29. The rivet also has head 37. The opposed side portions 38 of clip 10 abut securely against internal surfaces 39 of clip 10 as shown in FIG. 3 and this provides one form of common retaining means and pivot means as described previously so as to enable panel 23 to be pivoted about a longitudinal axis 40 as shown in FIG. 13 and be retained in a desired position which may correspond with a plane offset to the vertical.

FIG. 4 shows panel 23 having top V shaped part 41 having adjacent flanges 27 and 28, body portion 42 having reinforcing grooves 43 and bottom part 44 comprising oblique flange 45 and horizontal flange 46 with lip 47.

In FIGS. 5–9 carrier rail 29 is shown schematically and it will be appreciated as stated previously that rail 29 may comprise an elongate sheet or plate 29A if desired. However preferably rail 29 is of the channel form shown in FIG. 2 and thus numeral 29A may correspond to one flange 30.

In FIG. 5 clip 10 also shown schematically is freely pivoted on pivot pin 48 through washer 49 and is also provided with outwardly extending abutments 51 and 52 on each side thereof so as to engage with the underside 53 of member 29A.

In FIG. 6 there is shown spaced pivot lugs or pins 48 and a screw clamp 54 which may be inserted in a mating socket in clip 10 so as to urge together branch portions 55 of bifurcated end 56 of clip 10.

In FIG. 7 there is shown anchor lug 57 engaging in a corresponding socket 58 of clip 10 to retain clip 10 in a desired position offset to the vertical as shown.

In FIGS. 8A and 8B there is shown an abutment element in the form of a polygonal shaped lug 59 attached to plate 29A which engages with a correspondly shaped socket 60 of clip 10. As clip 10 pivots relative to plate 29A it may be retained in any desired position by engagement between abutting edges of lug 59 and socket 60. This provides one form of pivoting clip 10 relative to plate 29A in angular increments of any suitable value. In the illustrated embodiment the lug 59 is in the shape of an octagon and hence angular increments of 45 degrees are appropriate. It will also be appreciated that an alternative arrangement is possible wherein the lug 59 may be attached to carrier rail 29A and thus engage in socket 60 located in clip 10.

In FIG. 9 there is shown a retaining rib 61 of plate 29A which may selectively engage in a single groove of a plurality of grooves 62 of clip 10 to again provide an alternative embodiment to that shown in FIG. 8 concerning obtaining pivotal angular increments of movement of clip 10 relative to plate 29A.

In FIGS. 5–9 it will also be appreciated that instead of clip 10 engaging with an associate side surface of plate 29A as shown it is also possible for clip 10 to grip or engage with plate 29A on both opposed major surfaces thereof or alternatively on each external face of flange 30.

In FIG. 10 it is shown how panel 23 is pivoted about a transverse axis relative to clips 10 as may be required. In the arrangement shown in FIG. 10 the carrier rails 29 are of varying height thus providing angled panels 23 as well as vertically oriented panels 23. Various other arrangements of angled panels are also possible which may be achieved by suspending carrier rails at varying heights relative to the floor.

Figure 11:
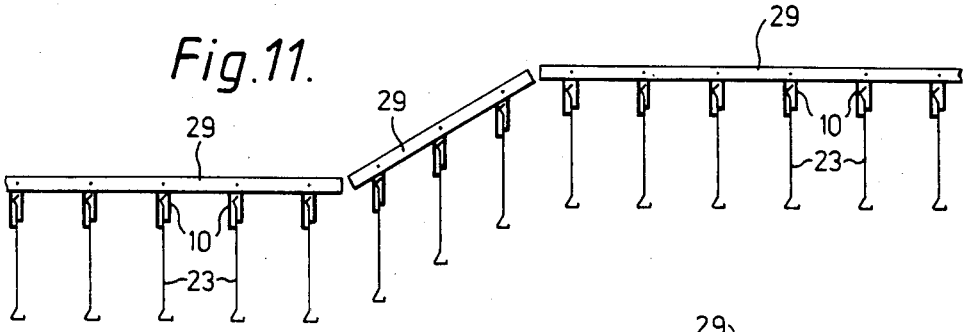
FIG. 11 is a side view showing three adjacent carrier rails showing all panels hanging vertically.
Figure 12:
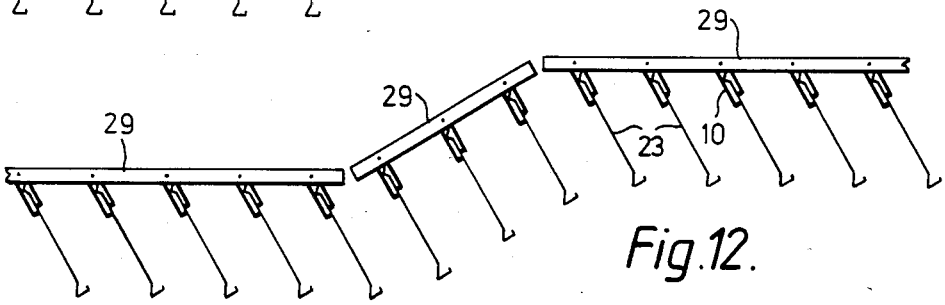
FIG. 12 is a view similar to FIG. 11 showing a different embodiment.

In FIGS. 11 and 12 there are shown various possible arrangements of horizontal carrier rails, vertical panels, angled panels and angled carrier rails. In FIGS. 11 and 12 angled carrier rails 29 are located intermediate horizontal carrier rails 29 and each panel 23 is oriented transverse to carrier rails 29 as shown. FIG. 11 shows vertically oriented panels 23, and in FIG. 12 all panels 23 are angled as shown. It is also possible for panels 23 to be inclined to the vertical at varying angles if such is required.

FIG. 13 shows one example of the range of pivotal movement possible for panel 23 about longitudinal axis 40 relative to carrier rail 29 wherein the two extremes of pivotal movement are shown in phantom and vertical position in full outline.

Figure 14:
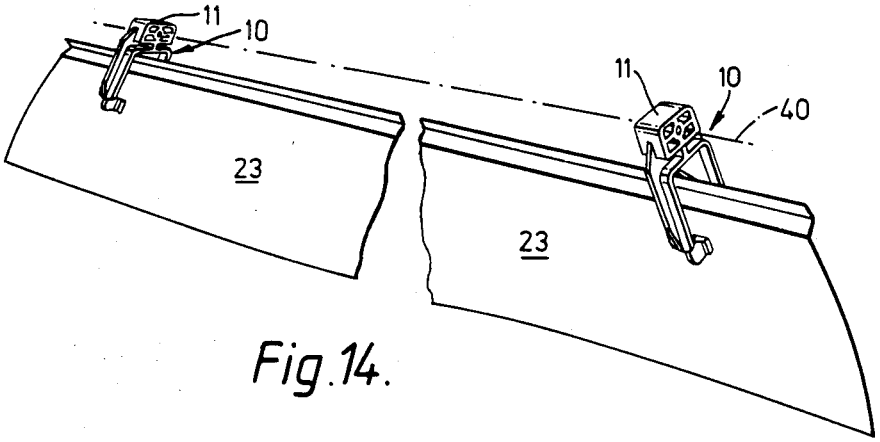
FIG. 14 is a perspective view showing twisting of an individual ceiling panel about a longitudinal axis.

In FIGS. 14 and 15 there is shown an embodiment wherein selective orientation of adjacent panels 23 about longitudinal axis 40 may provide a resulting arrangement where panels 23 may be arranged in a spiral or helical configuration or curved configuration. Thus in FIG. 14 a single panel 23 has a rear end portion oriented at a different angle to a front end portion as shown so that the panel is twisted about its mid-region. By twisting a plurality of adjacent panels in this way a curved arrangement may be obtained as shown by way of example in FIG. 15 which illustrates one particular curved arrangement which may be obtained by the present invention.

In FIG. 16 there is also shown a particular arrangement which is based on a straight line or planar configuration. Thus adjacent rows 63, 64, 65, 66 and 67 may be parallel or angled to each other as shown in FIG. 16 with the panels 23 of one row 66 offset to on or more of the other rows.

The invention also includes within its scope the aforementioned clip element per se.

I claim:

1. A screen ceiling assembly comprising a plurality of spaced carrier members, connectable to a support structure, to form a common plane through said carrier members; a multiplicity of spaced elongate ceiling panels each having its own longitudinal axis, said panels being positioned at an angle to said common plane; clip means interconnecting each ceiling panel with at least one of said carrier members; and a pivotal connection associated with each clip means, effective to allow each ceiling panel to be pivoted about an axis parallel to its longitudinal axis, whereby each panel may be disposed at a desired angle or angles with respect to said common plane, wherein said pivotal connection is formed directly between each clip means and an associated carrier.

2. A screen ceiling assembly as claimed in claim 1, and further comprising retaining means to retain each panel in said desired angled position.

3. A screen ceiling assembly as claimed in claim 1, wherein each clip means comprises a panel engagement portion and a separate head portion, said head portion being attached to the carrier member, and wherein the pivotal connection is provided between the panel engagement portion and the separate head portion.

4. A screen ceiling assembly as claimed in claim 1, wherein each clip means engages with an associated panel by engagement means, whereby the engagement means allow angular adjustment of the associated panel in its own plane with respect to the horizontal.

5. A screen ceiling assembly as claimed in claim 1, wherein each carrier member is of inverted channel shape comprising a top web and a pair of oppositely depending side flanges.

6. A screen ceiling assembly comprising a plurality of spaced carrier member, connectable to a support structure, to form a common plane through said carrier members; a multiplicity of spaced elongate ceiling panels each having its own longitudinal axis, said panels being positioned at an angle to said common plane; clip means interconnecting each ceiling panel with at least one of said carrier members; and a pivotal connection associated with each clip means, effective to allow each ceiling panel to be pivoted about an axis parallel to its longitudinal axis, whereby each panel may be disposed at a desired angle or angles with respect to said common plane, and further comprising retaining means to retain each panel in said desired angled position, wherein said retaining means comprises abutting elements on each clip means and its associated carrier member.

7. A screen ceiling assembly comprising a plurality of spaced carrier members, connectable to a support structure, to form a common plane through said carrier members; a multiplicity of spaced elongate ceiling panels each having its own longitudinal axis, said panels being positioned at an angle to said common plane; clip means interconnecting each ceiling panel with at least one of said carrier members; and a pivotal connection associated with each clip means, effective to allow each ceiling panel to be pivoted about an axis parallel to its longitudinal axis, whereby each panel may be disposed at a desired angle or angles with respect to said common plane, and further comprising retaining means to retain each panel in said desired angled position, wherein said retaining means comprises a detent element resiliently engagable in one or more recesses.

8. A screen ceiling assembly comprising a plurality of spaced carrier member, connectable to a support structure, to form a common plane through said carrier members; a multiplicity of spaced elongate ceiling panels each having its own longitudinal axis, said panels being positioned at an angle to said common plane; clip means interconnecting each ceiling panel with at least one of said carrier members; and a pivotal connection associated with each clip means, effective to allow each ceiling panel to be pivoted about an axis parallel to its longitudinal axis, whereby each panel may be disposed at a desired angle or angles wit respect to said common plane, and further comprising retaining means to retain each panel in said desired angled position, wherein said retaining means comprise an interengagable plug and socket arrangement.

9. A screen ceiling assembly comprising a plurality of spaced carrier members, connectable to a support structure, to form a common plane through said carrier members; a multiplicity of spaced elongate ceiling panels each having its own longitudinal axis, said panels being positioned at an angle to said common plane; clip means interconnecting each ceiling panel with at least one of said carrier members; and a pivotal connection asociated with each clip means, effective to allow each ceiling panel to be pivoted about an axis parallel to its longitudinal axis, whereby each panel may be disposed at a desired angle or angles with respect to said common plane, and further comprising retaining means to retain each panel in said desired angled position, wherein said retaining means allows pivoting at said pivotal connection to be effected incrementally, so that at least a part of each clip means may be retained in any one of a number of different incremental angular positions relative to its associated carrier member.

10. A screen ceiling assembly comprising a plurality of spaced carrier members, connectable to a support structure, to form a common plane through said carrier members; a multiplicity of spaced elongate ceiling panels each having its own longitudinal axis, said panels being positioned at an angle to said common plane; clip means interconnecting each ceiling panel with at least one of said carrier members; and a pivotal connection associated with each clip means, effective to allow each ceiling panel to be pivoted about an axis parallel to its longitudinal axis, whereby each panel may be disposed at a desired angle or angles with respect to said common plane, and further comprising retaining means to retain each panel in said desired angled position, wherein the carrier members each include a flange portion, an aligned aperture in each flange portion, and further comprising a fastening member extending through said clip means and said aperture to mount said clip means on said carrier member and allow the pivotal position thereof to be adjusted to the desired position.

11. A screen ceiling assembly as claimed in claim 10, and further comprising means to maintain said desired position by frictional engagement with said fastening member.

* * * * *